US007633366B2

(12) United States Patent
Hirai et al.

(10) Patent No.: US 7,633,366 B2
(45) Date of Patent: Dec. 15, 2009

(54) WIRE-WOUND COIL

(75) Inventors: Shinya Hirai, Yokohama (JP); Takaomi Toi, Machida (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 79 days.

(21) Appl. No.: 12/124,314

(22) Filed: May 21, 2008

(65) Prior Publication Data

US 2008/0224813 A1 Sep. 18, 2008

Related U.S. Application Data

(63) Continuation of application No. PCT/JP2006/323247, filed on Nov. 21, 2006.

(30) Foreign Application Priority Data

Nov. 22, 2005 (JP) ..... 2005-337199

(51) Int. Cl.
*H01F 27/02* (2006.01)

(52) U.S. Cl. ..... 336/83

(58) Field of Classification Search ..... 336/65, 336/83, 192, 200, 212, 220–223, 232
See application file for complete search history.

(56) References Cited

U.S. PATENT DOCUMENTS 4,314,221 A * 2/1982 Satou et al. ..... 336/83
6,144,280 A * 11/2000 Amada et al. ..... 336/192
6,242,996 B1 * 6/2001 Sato et al. ..... 336/200
6,348,850 B1 2/2002 Kimura et al.
6,373,366 B1 4/2002 Sato et al.
6,566,993 B1 * 5/2003 Otsuka et al. ..... 336/83
6,825,746 B2 * 11/2004 Otsuka et al. ..... 336/83
6,965,289 B2 11/2005 Toi et al.
7,212,093 B2 * 5/2007 Singu et a ..... 336/83
2002/0084878 A1 7/2002 Kimura et al.
2006/0267719 A1 * 11/2006 Yasuda et al. ..... 336/223

FOREIGN PATENT DOCUMENTS

JP 07-106137 A 4/1995
JP 07-297045 A 11/1995
JP 10-163029 A 6/1998

(Continued)

OTHER PUBLICATIONS

Official communication issued in the International Application No. PCT/JP2006/323247, mailed on Mar. 6, 2007.

*Primary Examiner*—Tuyen Nguyen
(74) *Attorney, Agent, or Firm*—Keating & Bennett, LLP

(57) ABSTRACT

A wire-wound coil includes a ferrite core having a winding core portion and flange portions, a wire wound around the winding core portion, electrodes connected to the wire on lower surfaces of the flange portions, and a ferrite plate attached to upper surfaces of both of the end flange portions so as to extend over the winding core portion. The flange portions and the ferrite plate are provided with corresponding recessed and projecting portions and, and the flange portions and the ferrite plate are integrated through the recessed and projecting portions. Joint sections between the flange portions and the ferrite plate include contact sections that are in direct contact with each other, and adhesion sections arranged to receive an adhesive.

10 Claims, 8 Drawing Sheets

FOREIGN PATENT DOCUMENTS

| | | | |
|---|---|---|---|
| JP | 11-251150 | A | 9/1999 |
| JP | 2003-234218 | A | 8/2003 |
| JP | 2004-039876 | A | 2/2004 |
| JP | 2004-146683 | A | 5/2004 |
| JP | 2005-056934 | A | 3/2005 |
| JP | 2005-093564 | A | 4/2005 |
| JP | 2005-310947 | A | 11/2005 |
| JP | 2005-322776 | A | 11/2005 |

* cited by examiner

WIRE-WOUND COIL

BACKGROUND OF THE INVENTION

1. Field of the Invention

The present invention relates to wire-wound coils, and more specifically, to a wire-wound coil capable of reducing magnetic flux leakage to improve the efficiency of obtaining inductance.

2. Description of the Related Art

Known wire-wound coils of this type include common-mode choke coils described in, for example, Japanese Unexamined Patent Application Publication No. 2003-168611, Japanese Unexamined Patent Application Publication No. 10-163029, and Japanese Unexamined Patent Application Publication No. 2005-056934. As shown in, for example, FIG. 10A, a high-frequency common-mode choke coil described in Japanese Unexamined Patent Application Publication No. 2003-168611 includes a core 1 having a winding core portion 1A and flange portions 1B, a wire 2 wound around the winding core portion 1A of the core 1, electrodes 3 provided on lower surfaces of the flange portions 1B of the core 1, and a ferrite plate 5 adhered by an adhesive 4 to upper surfaces of the both end flange portions 1B so as to extend over the winding core portion 1A. The ends of the wire 2 are electrically connected to the electrodes 3.

In a common-mode choke coil described in Japanese Unexamined Patent Application Publication No. 10-163029, as shown in FIG. 10B, flange portions 6A at both ends of a soft-magnetic drum core 6 are provided with projecting portions 7 for electrodes, and the projecting portions 7 for electrodes are provided with electrodes (not shown). A soft-magnetic return magnetic path member 8 having a substantially U-shaped configuration and the drum core 6 are engaged with each other to define a closed magnetic path. In FIG. 10B, reference numeral 9 denotes pullout lead portions at both ends of a coil winding.

Although not shown in the figures, a common-mode filter described in Japanese Unexamined Patent Application Publication No. 2005-056934 has a structure that is similar to that of the common-mode choke coil of Japanese Unexamined Patent Application Publication No. 2003-168611. However, this common-mode filter is different from the high-frequency common-mode choke coil of Japanese Unexamined Patent Application Publication No. 2003-168611 in that flange portions of a core and a ferrite plate are joined to each other by an adhesive through recessed and projecting portions.

In the high-frequency common-mode choke coil of Japanese Unexamined Patent Application Publication No. 2003-168611, since the flange portions 1B of the core 1 and the ferrite plate 5 are joined and fixed by the adhesive 4, a space having no magnetic material, which corresponds to an adhesive layer, is disposed between the ferrite plate 5 and the flange portions 1B. Magnetic flux leaks from this space, and the efficiency of obtaining inductance is reduced. For a similar reason, the common-mode filter of Japanese Unexamined Patent Application Publication No. 2005-056934 also causes magnetic flux leakage.

Also in the common-mode choke coil of Japanese Unexamined Patent Application Publication No. 10-163029, similar to Japanese Unexamined Patent Application Publication No. 2003-168611 and Japanese Unexamined Patent Application Publication No. 2005-056934, magnetic flux leakage occurs because the flange portions 6A of the drum core 6 and the U-shaped return magnetic path member 8 are adhered and joined by an adhesive. Japanese Unexamined Patent Application Publication No. 10-163029 describes that gaps corresponding to the joint portions between the flange portions 6A and the return magnetic path member 8 are minimized. If the gaps are minimized, however, the joining strength between the drum core 6 and the return magnetic path member 8 is reduced, resulting in reduced reliability. A positioning projecting portion (not shown) is further provided between the drum core 6 and a wire-winding portion to facilitate engagement between the drum core 6 and the return magnetic path member 8 to easily join the drum core 6 to the return magnetic path member 8. The return magnetic path member 8 and the positioning projecting portion limit the space for winding the wire. It is therefore difficult to use a thick wire and a desired number of winding turns may not be obtained.

SUMMARY OF THE INVENTION

To overcome the problems described above, preferred embodiments of the present invention provide a wire-wound coil capable of reducing magnetic flux leakage from a joint portion between a flange portion of a core and a ferrite plate to increase effective magnetic permeability, and therefore, to improve the efficiency of obtaining inductance.

A wire-wound coil according to a preferred embodiment of the present invention includes a core having a winding core portion, and flange portions provided at both ends thereof, a winding wound around the winding core portion of the core, electrodes provided on the flange portions and connected to ends of the winding, and a ferrite plate connected to upper portions of the flange portions defined at both ends so as to extend over the winding core portion. The flange portions and the ferrite plate are provided with recessed and projecting portions that correspond to each other. The flange portions and the ferrite plate are integrated through the recessed and projecting portions. Joint sections between the flange portions and the ferrite plate include contact sections that are in direct contact with each other and adhesion sections defined by using an adhesive.

Preferably, the adhesion sections of the flange portions are provided with portions at which the adhesive accumulates.

A ratio (B/A) of a flange size B on the side of the ferrite plate to a flange size A on the opposite side of the ferrite plate is preferably about 1 or less.

A ratio (D/C) of a size D in a width direction of the projecting portions or recessed portions of the ferrite plate to a size C in the width direction of an upper surface of the ferrite plate is preferably about 0.7 or less.

A ratio (E/F) of a thickness E of a flat portion of the ferrite plate to a height F of each of the projecting portions of the ferrite plate is preferably about 1 or less.

According to preferred embodiments of the present invention, a wire-wound coil capable of reducing magnetic flux leakage from a joint portion between a flange portion of a core and a ferrite plate to increase effective magnetic permeability, and therefore, capable of improving the efficiency of obtaining inductance is obtained.

Other features, elements, steps, characteristics and advantages of the present invention will become more apparent from the following detailed description of preferred embodiments of the present invention with reference to the attached drawings.

BRIEF DESCRIPTION OF DRAWINGS

FIG. 2A is a diagram of a ferrite core thereof as viewed from the ferrite plate side; FIG. 2B is a diagram of the ferrite core as viewed from the opposite side of a ferrite plate; and FIG. 2C is a diagram of the ferrite plate as viewed from the ferrite core side.

FIG. 3A is a perspective view of a ferrite core as viewed from the ferrite plate side; and FIG. 3B is a front view showing a portion enclosed with a circle shown in FIG. 3A in an enlarged manner, in which the ferrite core shown in FIG. 3A and the ferrite plate shown in FIG. 2C are joined.

DETAILED DESCRIPTION OF PREFERRED EMBODIMENTS

Figure 1:
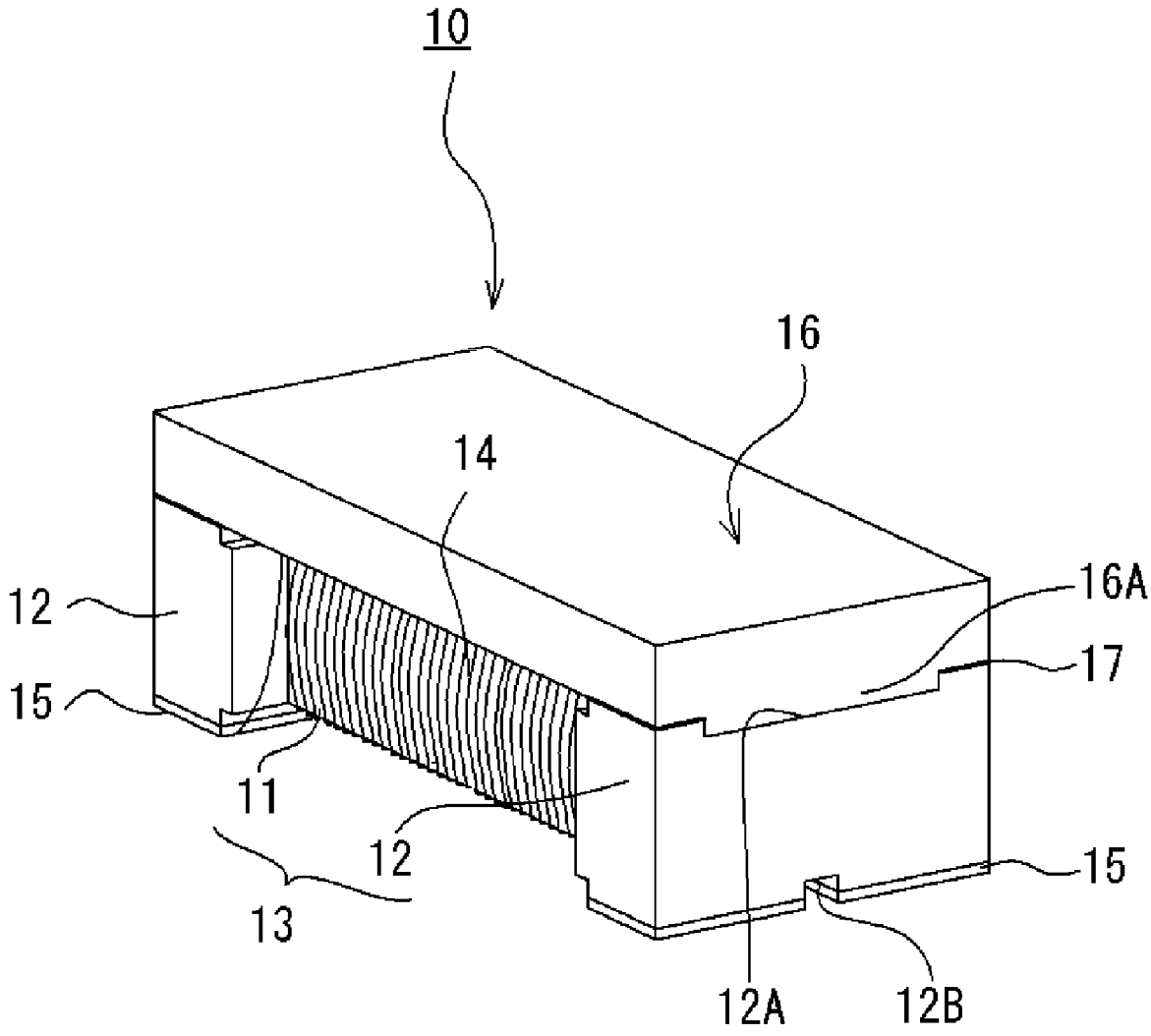
FIG. 1 is a perspective view showing a wire-wound coil of a preferred embodiment of the present invention.

The present invention will be described hereinafter with respect to preferred embodiments shown in FIGS. 1 to 8.

First Preferred Embodiment

As shown in FIGS. 1 and 2A to 2C, a wire-wound coil 10 of this preferred embodiment includes, for example, a ferrite core 13 having a winding core portion 11 and flange portions 12 provided at both ends thereof, an insulation-coated winding (hereinafter referred to as a "wire") 14 wound around the winding core portion 11 of the ferrite core 13, electrodes 15 provided on lower surfaces of the flange portions 12 and connected to the ends of the wire 14, and a ferrite plate 16 that extends over the winding core portion 11 in a longitudinal direction and is joined to upper surfaces of the flange portions 11B defined at the ends thereof.

Figure 2A:
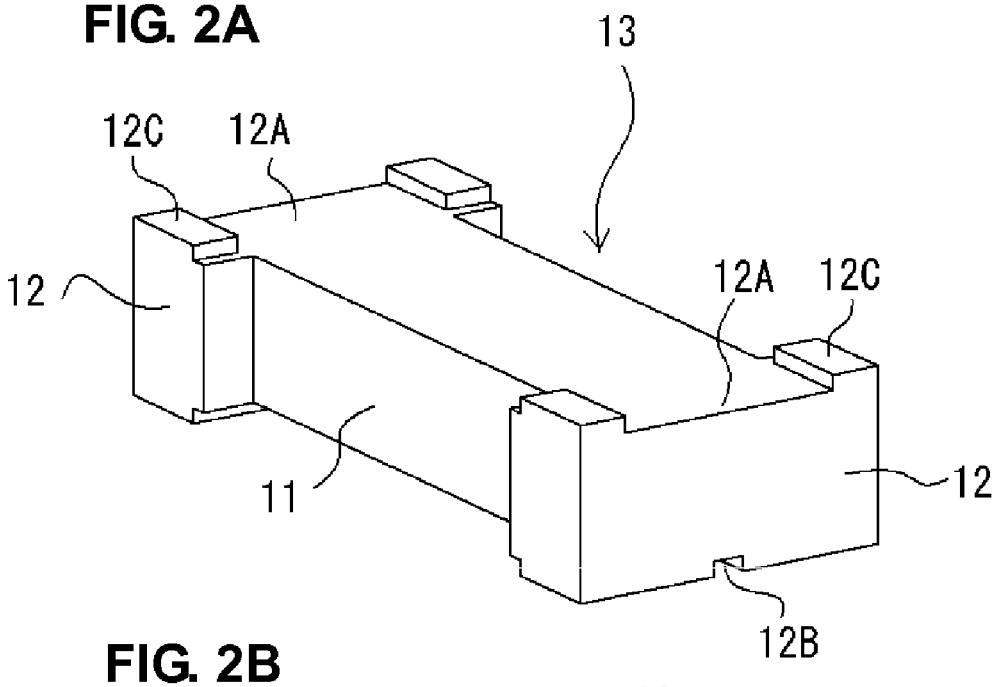
FIGS. 2A to 2C are perspective views of the wire-wound coil shown in FIG. 1.
Figure 2B:
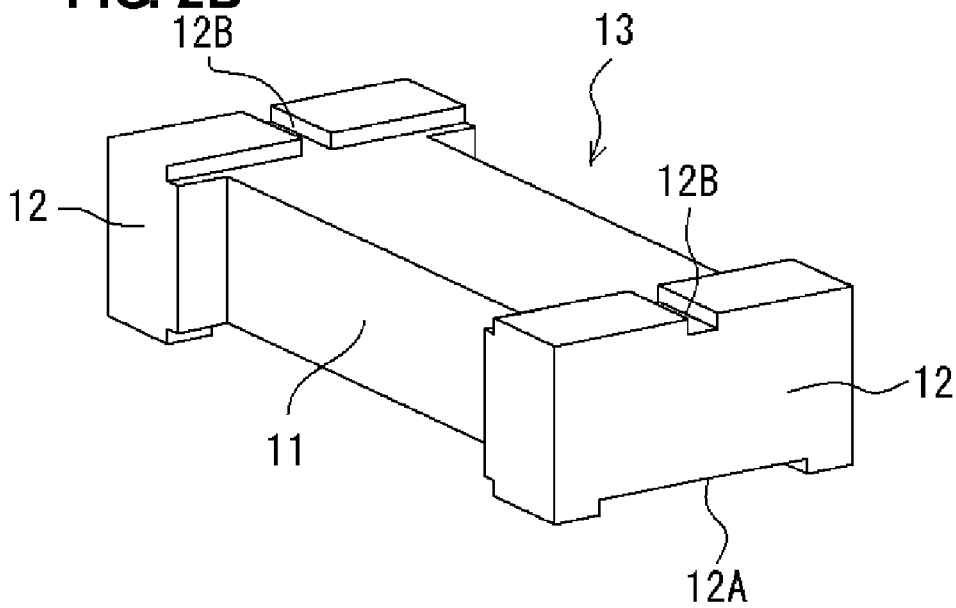
Figure 2C:
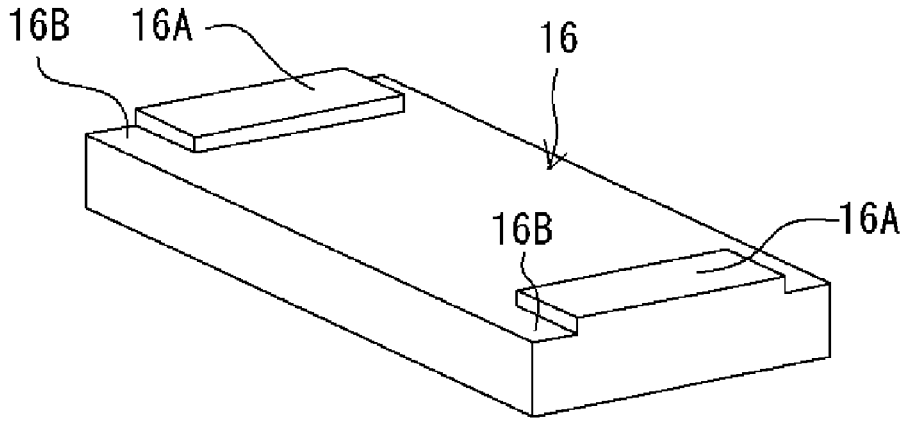

As shown in FIGS. 1 and 2A, a recessed portion 12A is provided at a center portion of the upper surface of each of the flange portions 12, and a recessed portion 12B, which is narrower than the recessed portions 12A, is provided at a center portion of the lower surface of each of the flange portions 12. As shown in FIGS. 2A and 2B, the recessed portions 12A and 12B of the flange portions 12 have flat bottom surfaces having no step with respect to the winding core portion 11. As shown in FIGS. 1 and 2C, a pair of projecting portions 16A corresponding to the recessed portions 12A of the flange portions 12 are provided at both ends in longitudinal direction of the ferrite plate 16. The projecting portions 16A are engaged with the recessed portions 12A of the flange portions 12 with no space therebetween. As shown in FIG. 2C, portions of the ferrite plate 16, except for the projecting portions 16A, are flat surface portions corresponding to upper surface portions of the flange portions 12, except for the recessed portions 12A. The projecting portions 16A of the ferrite plate 16 and the recessed portions 12A of the flange portions 12 are configured so as to be closely fitted to each other. The flange portions 12 and the ferrite plate 16 are engaged with each other at the recessed and projecting portions 12A and 16A, respectively, and are magnetically integrated. FIG. 2B shows an upside down view of the ferrite core 13 shown in FIG. 2A.

The flange portions 12 and the ferrite plate 16 are not adhered although the recessed and projecting portions 12A and 16A are engaged and are in direct contact with each other. Thus, as shown in FIG. 1, the portions of the flange portions 12 and the ferrite plate 16, except for the recessed and projecting portions 12A and 16A, are securely adhered to each by an adhesive 17 (indicated by thick lines in FIG. 1). The adhesive 17 is preferably a thermosetting resin adhesive, such as an epoxy resin adhesive, for example. In the following description, portions at both sides of the recessed and projecting portions 12A and 16A of the flange portions 12 and the ferrite plate 16 to which an adhesive is applied are referred to as adhesion portions 12C and 16B, respectively.

Since the flange portions 12 and the ferrite plate 16 are configured such that the recessed and projecting portions 12A and 16A are in direct contact with each other and are magnetically integrated, magnetic flux leakage is reduced at those portions to increase effective magnetic permeability, and magnetic flux efficiently passes along those. Therefore, the efficiency of obtaining inductance is improved. Further, the flange portions 12 and the ferrite plate 16 are configured such that the portions other than the recessed and projecting portions 12A and 16A (i.e., the adhesion portions 12C and 16B) are joined by the adhesive 17 and are securely mechanically integrated. Therefore, the connection reliability between the flange portions 12 and the ferrite plate 16 is outstanding, resulting in a high mechanical strength of the wire-wound coil 10. Further, as described above, the ferrite core 13 and the ferrite plate 16 are integrated at the flange portions 12 through the recessed and projecting portions 12A and 16A. Therefore, the winding core portion 11 of the ferrite core 13 can be effectively used without wasting any winding space of the wire 14.

In order to assemble the wire-wound coil 10, the wire 14 is wound a predetermined number of turns around the winding core portion 11 of the ferrite core 13 using a known method, and the ends of the wire 14 are electrically connected to the electrodes 15. Then, the adhesive 17 is applied to the adhesion portions 12C defined at both sides of the recessed portions 12 of the flange portions 12 using a technique such as dip-coating, for example. Then, the ferrite core 13 and the ferrite plate 16 are joined by engaging the recessed portions 12A of the flange portions 12 with the projecting portions 16A of the ferrite plate 16 so that the recessed portions 12A and the projecting portions 16A are in close contact with each other, adhering the adhesion portions 12C and 16B, then hot-pressing the ferrite core 13 and the ferrite plate 16 to cure the adhesive 17, and joining the flange portions 12 and the ferrite plate 16 in an integral unit. Thus, the wire-wound coil 10 is obtained. The adhesive 17 may be applied to the adhesion portions 16B defined at both sides of the projecting portions 16A of the ferrite plate 16 instead of being applied to the adhesive portions 12C of the flange portions 12.

As described above, according to this preferred embodiment, the flange portions 12 and the ferrite plate 16 are provided with the corresponding recessed and projecting portions 12A and 16A, respectively, and the recessed and projecting portions 12A and 16A are in direct contact with each other to magnetically integrate the flange portions 12 and the ferrite plate 16. Therefore, leakage of magnetic flux from the joint portions between the flange portions 12 of the ferrite core 13 and the ferrite plate 16 is reduced to increase the effective magnetic permeability, and therefore, the efficiency of obtaining inductance is improved. Further, since the portions of the flange portions 12 and the ferrite plate 16, except for the recessed and projecting portions 12A and 16A, are adhered by the adhesive 17, the ferrite core 13 and the ferrite plate 16 are securely joined at those portions. This ensures sufficient mechanical strength of the wire-wound coil 10.

Second Preferred Embodiment

It was discovered that the wire-wound coil 10 of the first preferred embodiment might cause a reduction of inductance because the pressure applied when the ferrite core 13 and the ferrite plate 16 are combined might cause the adhesive 17 to flow into the joining surfaces of the winding portion and the recessed and projecting portions 12A and 16A due to capillary effect. A wire-wound coil of this preferred embodiment is configured such that sections at which a ferrite core and a ferrite plate are adhered are specifically designed to overcome such a problem. In describing the wire-wound coil of this preferred embodiment, portions of the wire-wound coil corresponding to those of the first preferred embodiment are denoted by the same numerals, and the characteristic features of the wire-wound coil of this preferred embodiment will primarily be described.

Figure 3A:
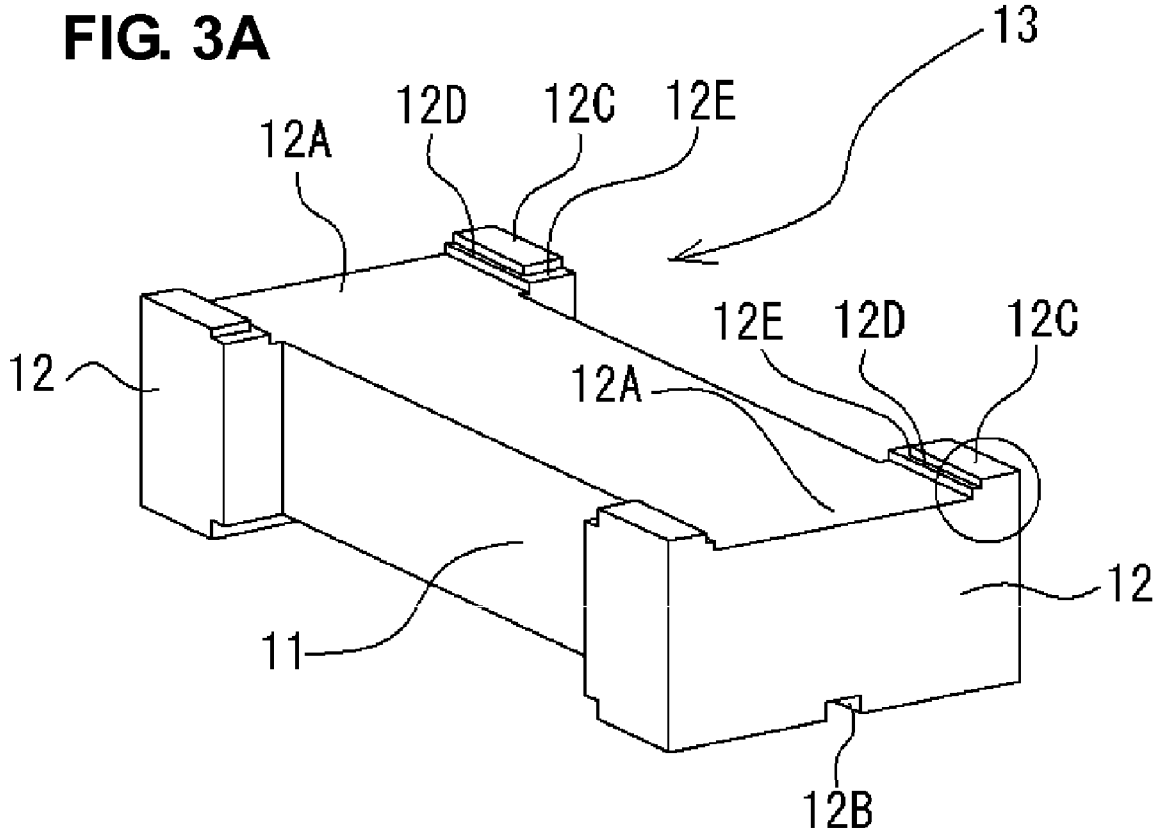
FIGS. 3A and 3B are diagrams showing a wire-wound coil of another preferred embodiment of the present invention.

As shown in FIG. 3A, a wire-wound coil 10A of this preferred embodiment includes improved adhesion portions 12C of the flange portions 12 of the ferrite core 1. That is, as shown in FIG. 3A, the adhesion portions 12C provided at both ends of the recessed portions 12A of the flange portions 12 include first and second accumulating portions 12D and 12E in which the adhesive 17 (see FIG. 3B) accumulates. The adhesive 17 that overflows from the joint portions due to the pressure applied during joining accumulates in the first and second accumulating portions 12D and 12E. The first accumulating portions 12D are stepped portions defined in surfaces of the adhesive portions 12C that are near the recessed portions 12A so as to cut off the surfaces in a central portion thereof. The second accumulating portions 12E are stepped portions that continuously extend along the inside surfaces of the adhesion portions 12C (the surfaces of the left and right flange portions 12 that face each other) from the first accumulating portions 12D and have a substantially L shape.

Figure 3B:
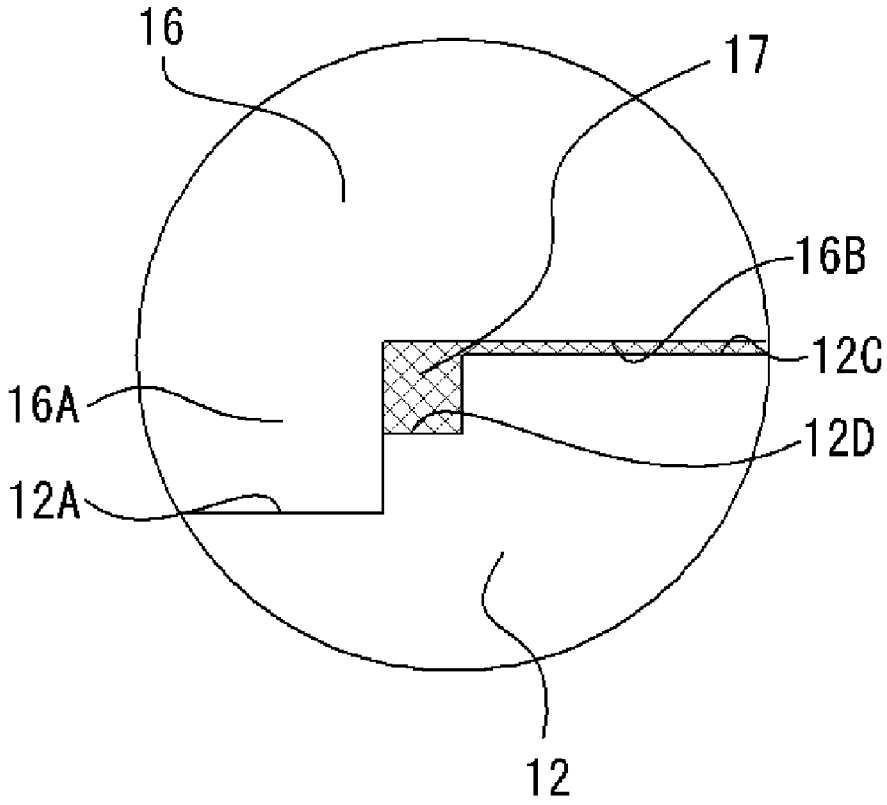

The first accumulating portions 12D are portions in which the excessive adhesive 17 that overflows from the adhesion portions 12C and 16B of the flange portions 12 and the ferrite plate 16 accumulates in the manner shown in FIG. 3B when the ferrite core 13 and the ferrite plate 16 are joined, and prevent the adhesive 17 from penetrating into directly contacting portions of the recessed and projecting portions 12A and 16A due to the capillary effect during pressure welding. Since the adhesive 17 is prevented from penetrating into the magnetically coupled recessed and projecting portions 12A and 16A, a reduction in the magnetically coupling between the recessed and projecting portions 12A and 16A is prevented and deterioration of the inductance of the wire-wound coil is therefore prevented.

The second accumulating portions 12E are portions in which the excessive adhesive 17 that overflows from the adhesion portions 12C and 16B of the flange portions 12 and the ferrite plate 16 accumulates, and prevent penetration of the adhesive 17 into the wire (winding portion) of the winding core portion 11. The adhesive 17 is prevented from penetrating into the winding portion to prevent deterioration of the insulation performance of the wire-wound coil under moisture resistance load conditions, and the reliability of the wire-wound coil is further improved.

According to this preferred embodiment, the adhesion portions 12C of the flange portions 12 are provided with the first and second accumulating portions 12D and 12E in which the adhesive 12 accumulates. The adhesion portions 12C of the flange portions 12 prevent penetration of the adhesive 17 into the magnetically coupled recessed and projecting portions 12A and 16A from the adhesion portions, and also prevent flow of the adhesive 17 into the winding portion. Therefore, deterioration of the inductance of the wire-wound coil and deterioration of insulation performance under moisture resistance load conditions are prevented, resulting in improved reliability of the wire-wound coil.

Other Preferred Embodiments

Figure 4A:
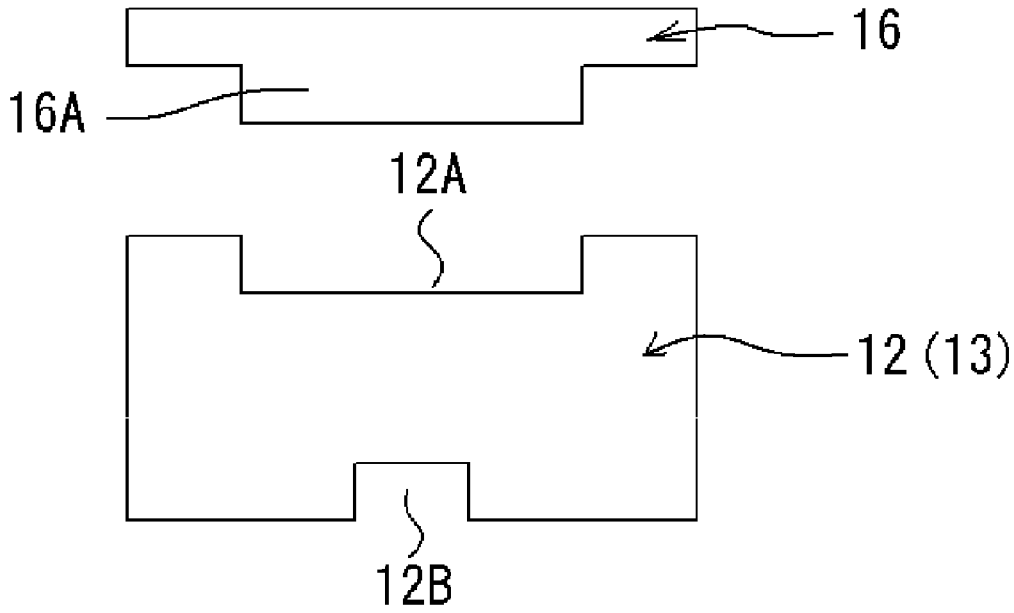
FIGS. 4A and 4B are front views showing the relationship between the ferrite cores and the ferrite plates of the wire-wound coils of the preferred embodiments of the present invention.
Figure 4B:
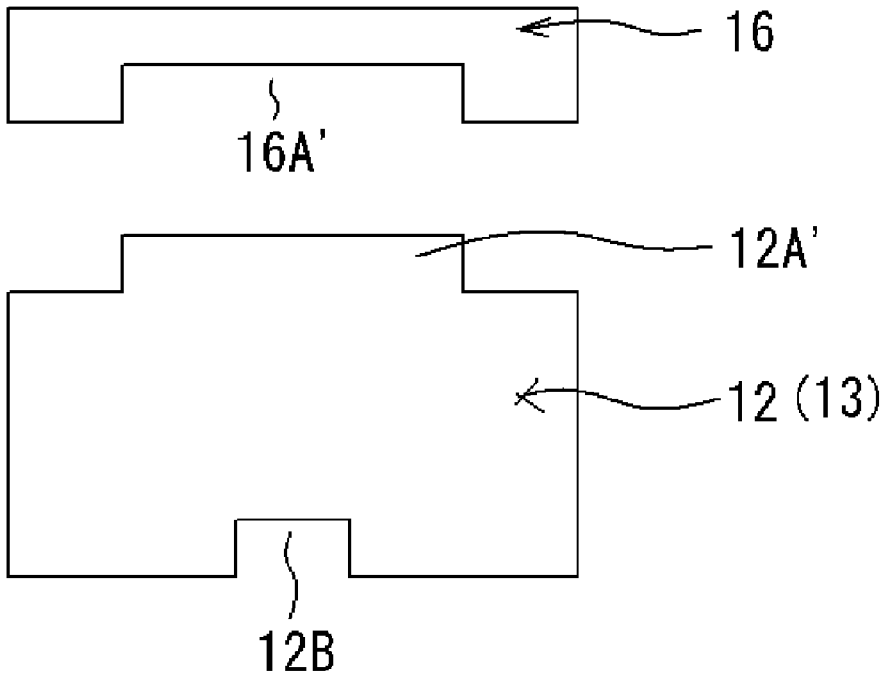

In the first and second preferred embodiments, as shown in FIG. 4A, the flange portions 12 of the ferrite core 13 are provided with the recessed portions 12A, and the ferrite plate 16 is provided with the projecting portions 16A. Alternatively, as shown in FIG. 4B, the recess-projection relationship maybe reversed. That is, the flange portions 12 of the ferrite core 13 may be provided with projecting portions 12A', and the ferrite plate 16 may be provided with recessed portions 16A' corresponding to the projecting portions 12A'. With this configuration, advantages similar to those of obtained in the first and second preferred embodiments are obtained.

Figure 5A:
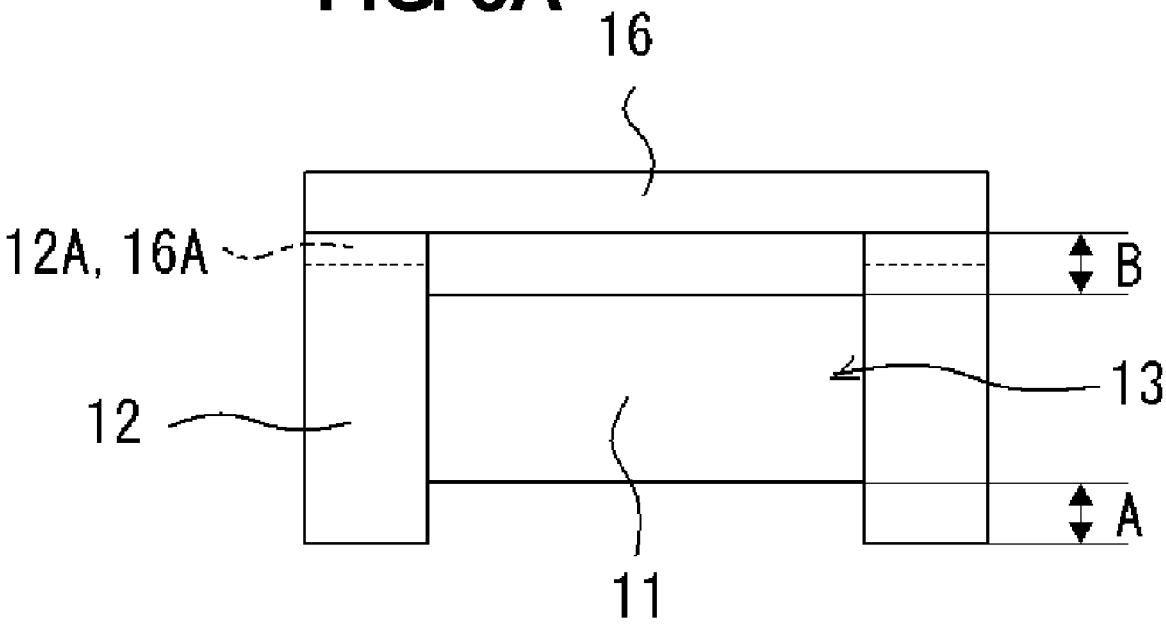
FIGS. 5A and 5B are diagrams showing the size of the ferrite core and ferrite plate shown in FIG. 1.
Figure 5B:
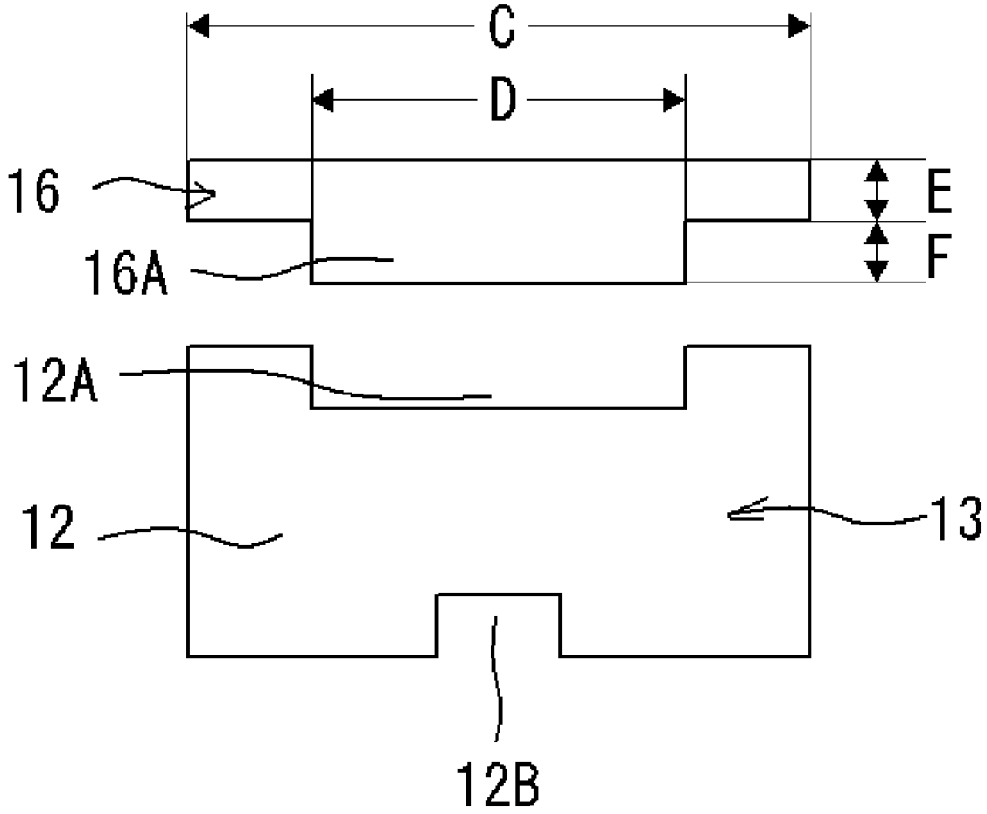

Next, the wire-wound coil of the first preferred embodiment will be described with reference to specific examples. In the examples, the relationships between the configurations of the ferrite core and the ferrite plate, and the inductance values of the wire-wound coil 10 were investigated using a wire-wound coil having a length of about 4.5 mm, a width of about 3.2 mm, and a height of about 2.6 mm. These relationships will be described with reference to FIGS. 5A to 9. Each of the ferrite core and ferrite plate used had a magnetic permeability of about 100. The ferrite core and the ferrite plate were formed into the configuration shown in FIGS. 5A and 5B. That is, as shown in FIG. 5A, the size of each of the flange portions 12 on the lower surface of the ferrite core 13 was denoted by A, and the size of each of the flange portions 12 on the upper surface thereof was denoted by B. As shown in FIG. 5B, the width of the ferrite plate 16 was denoted by C, and the width of each of the projecting portions 16A was denoted by D. The thickness of the flat portion of the ferrite plate 16 was denoted by E, and the height of each of the projecting portions 16A was denoted by F. The inductance values of the wire-wound coils were measured by changing the values of A to F.

The measurement of the inductance was performed using an impedance analyzer (main body: 4294 A) and a fixture (16193 A), which is manufactured by Agilent Technologies. Those were connected by an adaptor of about 7 mm, and the measurement was performed within a frequency range of about 40 KHz to about 110 MHz. An oscilloscope level of about 500 mV was applied, and a 201-point data set was taken.

EXAMPLE 1

Figure 6:
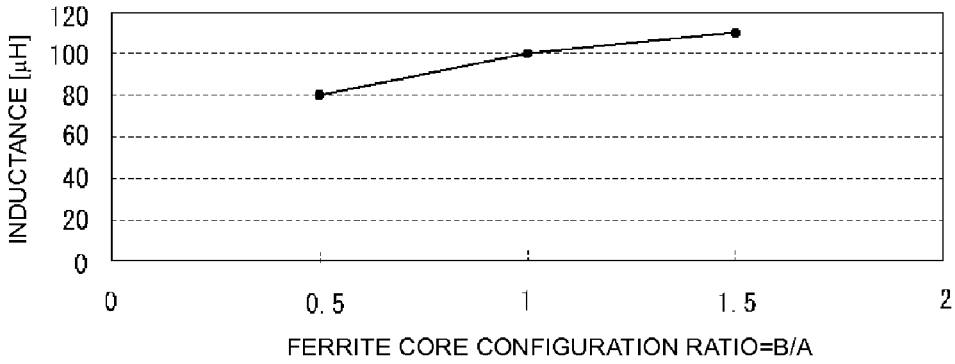
FIG. 6 is a graph showing the relationship between a configuration ratio (B/A) of the ferrite core shown in FIG. 1 and an inductance of the wire-wound coil.

In this example, the configuration of the ferrite core 13 was changed so as to change the ratio (B/A) of the size B of each of the flange portions on the upper surface of the ferrite core 13 to the size A of each of the flange portions on the lower surface thereof in the manner shown in FIG. 6, and the inductance of the wire-wound coil with respect to each of the ratios (B/A) was measured. As a result of the measurement, the results shown in FIG. 6 were obtained. According to the results shown in FIG. 6, the inductance value significantly changes when the configuration ratio (B/A) of the ferrite core 13 ranges from about 0.5 to about 1, and the inductance value changes by only a small amount, with a tendency to gradually reach a saturation region, when the configuration ratio (B/A) exceeds about 1. Therefore, it was found that a desired inductance value could be efficiently obtained by setting the configuration ratio (B/A) of the ferrite core 13 to about 1 or less.

EXAMPLE 2

Figure 7:
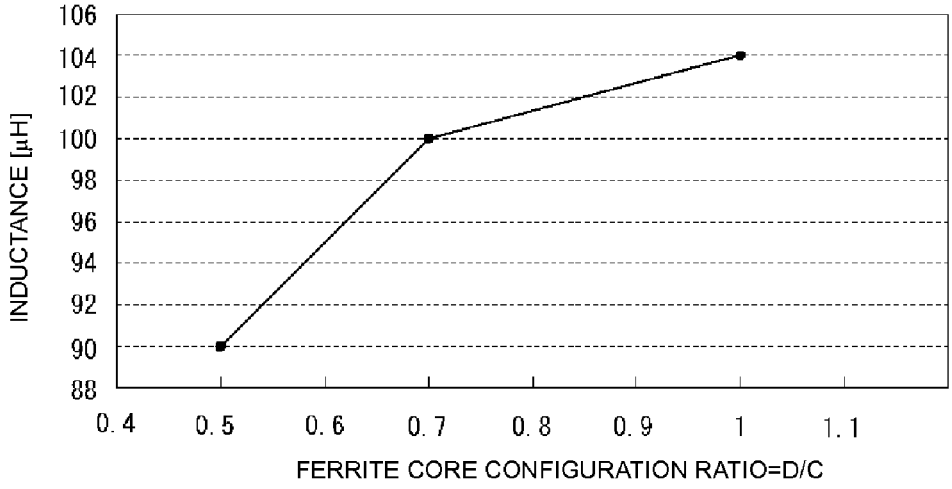
FIG. 7 is a graph showing the relationship between a configuration ratio (D/C) of the ferrite core shown in FIG. 1 and an inductance of the wire-wound coil.

In this example, the configuration of the ferrite core 13 was changed to change the ratio (D/C) of the length, denoted by D, of each of the projecting portions 16A to the width C of the ferrite plate 16 in the manner shown in FIG. 7, and the inductance of the wire-wound coil with respect to each of the ratios (D/C) was measured. As a result of the measurement, the results shown in FIG. 7 were obtained. According to the results shown in FIG. 7, the inductance value significantly changes when the configuration ratio (D/C) of the ferrite core 13 ranges from about 0.5 to about 0.7, and the inductance value changes by only a small amount, with a tendency to gradually reach a saturation region, when the configuration ratio (D/C) exceeds about 0.7. Therefore, it was found that a desired inductance value could be efficiently obtained by setting the configuration ratio (D/C) of the ferrite core 13 to about 0.7 or less.

EXAMPLE 3

Figure 8:
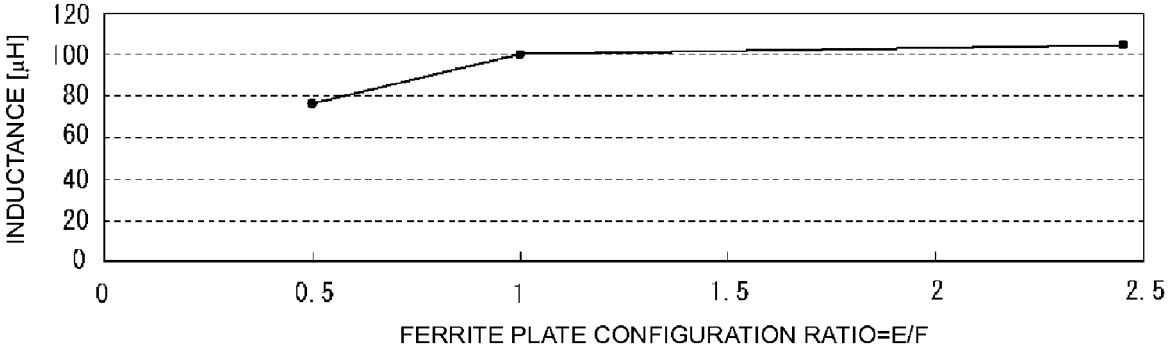
FIG. 8 is a graph showing the relationship between a configuration ratio (E/F) of the ferrite core shown in FIG. 1 and an inductance of the wire-wound coil.
Figure 9:
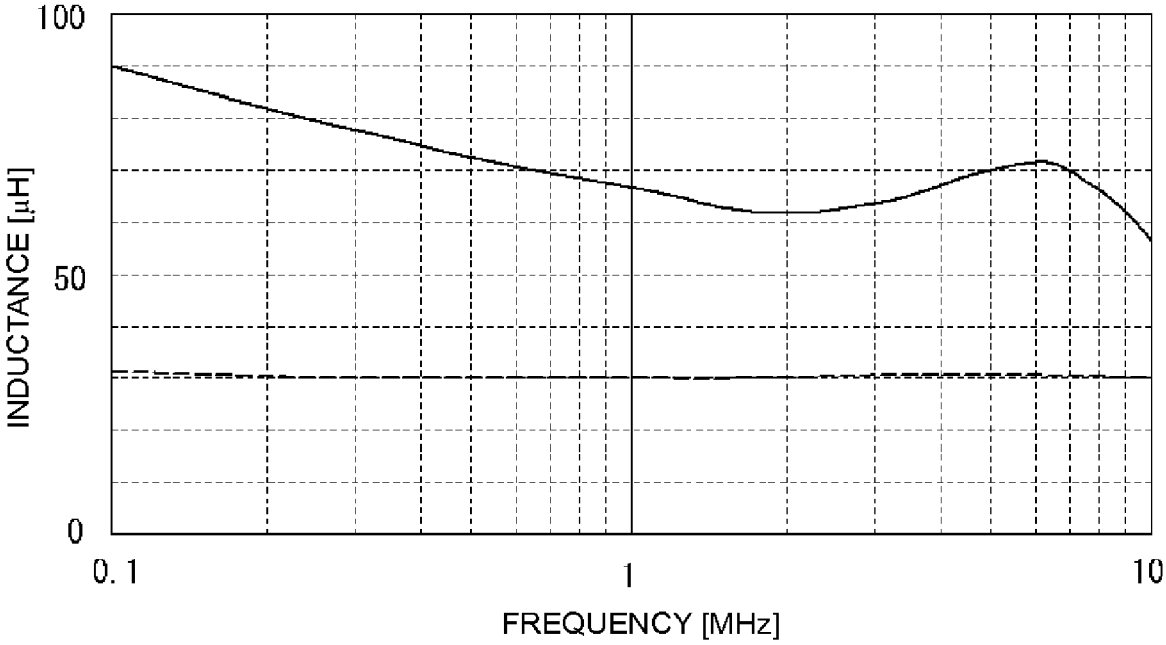
FIG. 9 is a graph showing the relationship between a frequency and inductance in the wire-wound coil having a preferred configuration ratio shown in FIG. 1.
Figure 10A:
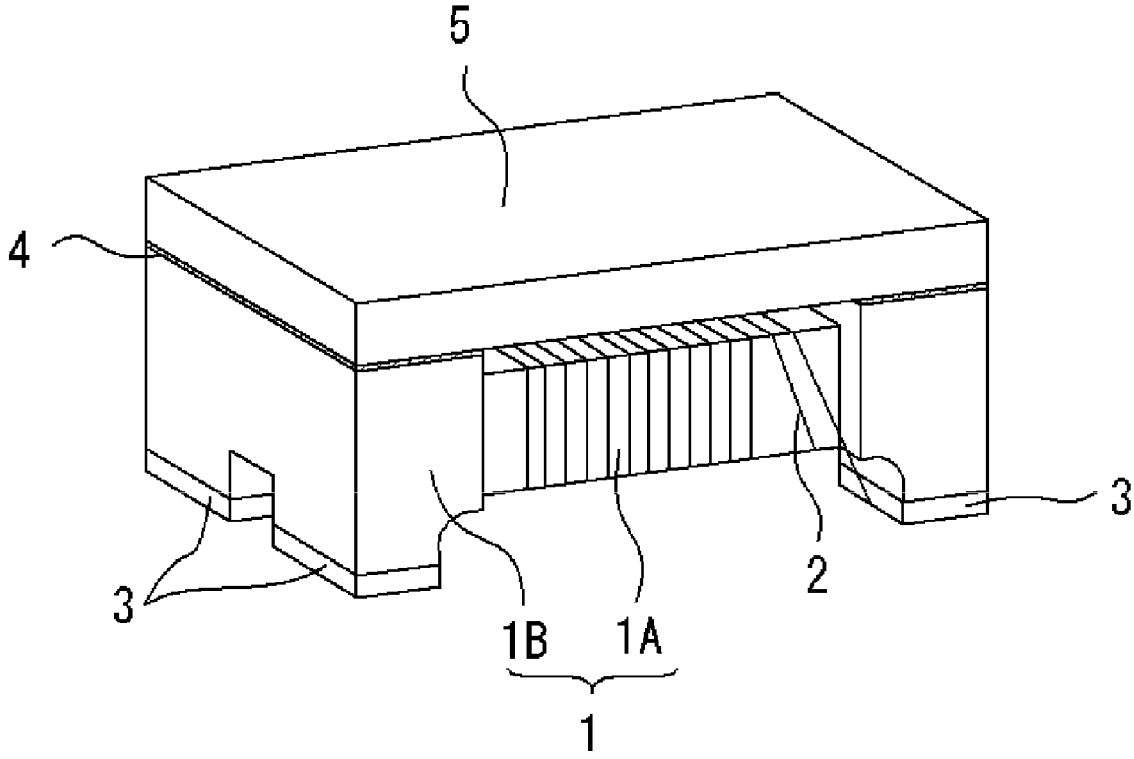
FIG. 10A Prior Art
FIGS. 10A and 10B are perspective views showing wire-wound coils of the related art.
Figure 10B:
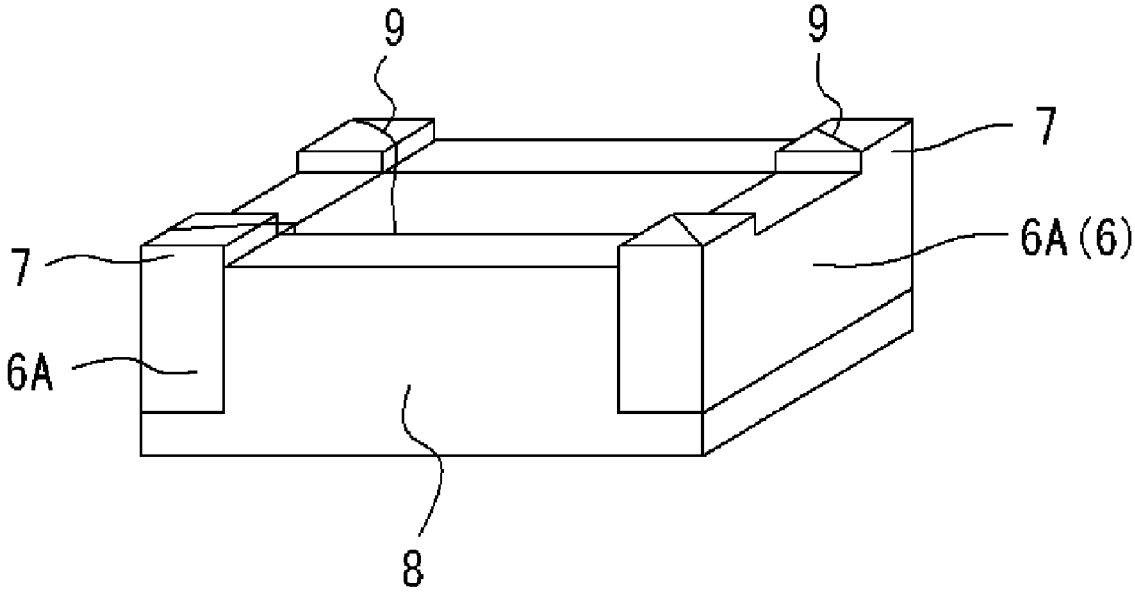
FIG. 10B Prior Art

In this example, the configuration of the ferrite core 13 was changed to change the ratio (E/F) of the thickness E of the flat portion of the ferrite plate 16 to the height F of each of the projecting portions in the manner shown in FIG. 8, and the inductance of the wire-wound coil with respect to each of the ratios (E/F) was measured. As a result of the measurement, the results shown in FIG. 8 were obtained. According to the results shown in FIG. 8, the inductance value significantly changes when the configuration ratio (E/F) of the ferrite core 13 ranges from about 0.5 to about 1, and the inductance value changes by only a small amount, with a tendency to gradually reach a saturation region, when the configuration ratio (E/F) exceeds about 1. Therefore, it was found that a desired inductance value could be efficiently obtained by setting the configuration ratio (E/F) of the ferrite core 13 to about 1 or less.

EXAMPLE 4

In this example, a wire-wound coil including the ferrite core 13 and ferrite plate 16 with sizes satisfying the conditions of Examples 1 to 3 was manufactured. That is, the ferrite core 13 had configuration ratios B/A=1, D/C=0.7, and E/F=1. The inductance of this wire-wound coil was changed in the frequency range of about 0.1 to about 10 MHz and measured. As a result of the measurement, the results indicated by a solid line shown in FIG. 9 were obtained. As a comparative example, a wire-wound coil was manufactured under the same conditions, except that the flange portions 12 and the ferrite plate 16 did not include recessed or projecting portions, and the inductance of this wire-wound coil was measured. As a result of the measurement, results indicated by a broken line shown in FIG. 9 were obtained. According to the results shown in FIG. 9, it was found that, in the measurement frequency range, the wire-wound coil of this example had a significantly larger inductance value than the wire-wound coil having no recessed or projecting portions and provided higher efficiency of obtaining inductance.

According to Examples 1 to 4, the efficiency of obtaining inductance was further improved by setting the ratio (B/A) of the flange size B on the ferrite plate 16 side to the flange size A on the opposite side of the ferrite plate 16 to about 1 or less, setting the ratio (D/C) of the width D of each of the projecting portions 16A of the ferrite plate 16 to the width C of the upper surface of the ferrite plate 16 to about 0.7 or less, and further setting the ratio (E/F) of the thickness E of the flat portion of the ferrite plate 16 to the height F of each of the projecting portions 16A of the ferrite plate 16 to about 1 or less.

The present invention is not limited to the foregoing preferred embodiments, and the relationships between the configuration ratios in Examples 1 to 4 can also be applied to the wire-wound coil of the second preferred embodiment. Therefore, any wire-wound coil configured such that a flange portion of a ferrite core and a ferrite plate are provided with recessed and projecting portions and the recessed and projecting portions are in direct contact with each other so that the ferrite core and the ferrite plate are magnetically integrated, wherein portions of the ferrite core and the ferrite plate, except for the recessed and projecting portions, are adhered by an adhesive, are within the scope of the present invention.

The present invention is suitably used for a wire-wound coil used in electronic equipment, communication equipment, and other suitable devices.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A wire-wound coil comprising:

a core having a winding core portion and flange portions provided at both ends of the winding core portion;

a winding wound around the winding core portion of the core;

electrodes provided on the flange portions and connected to ends of the winding; and a ferrite plate attached to upper portions of the flange portions so as to extend over the winding core portion; wherein each of the flange portions includes a projecting portion, and each of two opposed ends of the ferrite plate includes a recessed portion, the recessed portions and the projecting portions having complementary shapes;

the flange portions and the ferrite plate are engaged through the recessed portions and projecting portions; and in sections where the flange portions and the ferrite plate are engaged, contact sections are provided where the projecting portions of the flange portions and the recessed portions of the ferrite plate are in direct contact with each other, and remaining portions define adhesion sections arranged to receive an adhesive.

2. The wire-wound coil according to claim 1, wherein the adhesion sections of the flange portions are provided with portions having a structure arranged to accumulate the adhesive.

3. The wire-wound coil according to claim 1, wherein a ratio B/A of a flange size B on a side of the ferrite plate to a flange size A on an opposite side of the ferrite plate is about 1 or less.

4. The wire-wound coil according to claim 1, wherein a ratio D/C of a size D in a width direction of the projecting portions or recessed portions of the ferrite plate to a size C in the width direction of an upper surface of the ferrite plate is about 0.7 or less.

5. The wire-wound coil according to claim 1, wherein a ratio E/F of a thickness E of a flat portion of the ferrite plate to a height F of each of the projecting portions of the ferrite plate is about 1 or less.

6. A wire-wound coil comprising:

a core having a winding core portion and flange portions provided at both ends of the winding core portion;

a winding wound around the winding core portion of the core;

electrodes provided on the flange portions and connected to ends of the winding; and a ferrite plate attached to upper portions of the flange portions so as to extend over the winding core portion; wherein each of the flange portions includes a recessed portion, and each of two opposed ends of the ferrite plate includes a projecting portion, the recessed portions and the projecting portions having complementary shapes;

the flange portions and the ferrite plate are engaged through the recessed portions and projecting portions; and in sections where the flange portions and the ferrite plate are engaged, contact sections are provided where the recessed portions of the flange portions and the projecting portions of the ferrite plate are in direct contact with each other, and remaining portions define adhesion sections arranged to receive an adhesive.

7. The wire-wound coil according to claim 6, wherein the adhesion sections of the flange portions are provided with portions having a structure arranged to accumulate the adhesive.

8. The wire-wound coil according to claim 6, wherein a ratio B/A of a flange size B on a side of the ferrite plate to a flange size A on an opposite side of the ferrite plate is about 1 or less.

9. The wire-wound coil according to claim 6, wherein a ratio D/C of a size D in a width direction of the projecting portions or recessed portions of the ferrite plate to a size C in the width direction of an upper surface of the ferrite plate is about 0.7 or less.

10. The wire-wound coil according to claim 6, wherein a ratio E/F of a thickness E of a flat portion of the ferrite plate to a height F of each of the projecting portions of the ferrite plate is about 1 or less.

* * * * *